US010895424B2

(12) United States Patent
Tertin

(10) Patent No.: US 10,895,424 B2
(45) Date of Patent: Jan. 19, 2021

(54) FIREARM ACTION

(71) Applicant: Saeilo Enterprises, Inc., Greeley, PA (US)

(72) Inventor: James A. Tertin, Pillager, MN (US)

(73) Assignee: SAEILO ENTERPRISES, INC., Greeley, PA (US)

( * ) Notice: Subject to any disclaimer, the term of this patent is extended or adjusted under 35 U.S.C. 154(b) by 0 days.

(21) Appl. No.: 16/518,834

(22) Filed: Jul. 22, 2019

(65) Prior Publication Data

US 2020/0103187 A1 Apr. 2, 2020

Related U.S. Application Data

(60) Provisional application No. 62/702,523, filed on Jul. 24, 2018.

(51) Int. Cl.
*F41A 3/42* (2006.01)

(52) U.S. Cl.
CPC ..... *F41A 3/42* (2013.01)

(58) Field of Classification Search
CPC ..... F41A 3/42; F41A 3/64; F41A 3/38; F41A 3/40; F41A 3/46; F41A 3/48; F41A 3/34; F41A 3/36
USPC ..... 42/16, 14; 89/180–183, 194, 17, 18, 22, 89/24
See application file for complete search history.

(56) References Cited

U.S. PATENT DOCUMENTS 1,572,450 A * 2/1926 Swebilius ..... F41A 19/33 89/144
1,837,512 A * 12/1931 Young ..... F41A 3/40 42/21
2,296,242 A * 9/1942 Brewer ..... 89/194
2,342,703 A * 2/1944 Simpson ..... 42/16
2,352,193 A * 6/1944 Gorton ..... 89/164
2,396,564 A * 3/1946 Gal ..... 89/152
2,427,304 A * 9/1947 Robbins ..... 89/149
2,429,650 A * 10/1947 Schiff ..... 89/149
2,554,618 A * 5/1951 Dixon ..... F41A 5/22 89/193
2,601,808 A * 7/1952 Clarke ..... F41A 3/40 89/190

(Continued)

OTHER PUBLICATIONS

Heckler & Koch, "Automatic Rifle HK G3 Caliber 7.62 mm × 51 Nato," Publication date unknown, p. 27, Survival Books Inc.

*Primary Examiner* — John Cooper
(74) *Attorney, Agent, or Firm* — Bennet K. Langlotz; Langlotz Patent & Trademark Works, LLC

(57) ABSTRACT

A firearm action has a receiver defining a bolt passage and having a latch engagement facility, a bolt assembly including a bolt body received in the passage and operable to reciprocate between a forward battery position and a rear open position, the bolt assembly including a bolt handle movable with respect to the body between a handle forward position and a handle rearward position, the bolt assembly including a bolt latch body having a latch element, the bolt latch body movable between a locked condition in which the latch element engages the latch engagement facility when the bolt assembly is in the forward position and the bolt handle is in the forward position to prevent reciprocation of the bolt, and an unlocked position in which the latch element is disengaged from the latch engagement facility to enable reciprocation of the bolt.

22 Claims, 11 Drawing Sheets

(56) References Cited

U.S. PATENT DOCUMENTS 2,667,816 A * 2/1954 Simpson ..... F41A 19/30 89/149
2,730,928 A * 1/1956 Saetter-Lassen ..... F41A 3/40 89/190
2,960,917 A * 11/1960 Lizza ..... F41A 3/26 89/190
2,962,936 A * 12/1960 Muhlemann ..... F41A 5/18 89/190
3,405,471 A * 10/1968 Koncky ..... F41A 3/64 42/75.02
3,416,404 A * 12/1968 Fowler ..... F41A 3/40 89/190
3,613,282 A * 10/1971 Ramsay ..... F41A 19/58 42/17
3,845,689 A * 11/1974 Zanoni ..... F41A 3/40 89/181
3,866,344 A * 2/1975 Kawamura ..... F41A 3/40 42/16
3,938,423 A * 2/1976 Schertz ..... F41A 3/38 89/176
4,015,512 A * 4/1977 Feerick ..... F41A 3/40 89/190
4,044,487 A * 8/1977 Hutton ..... F41A 35/02 42/16
4,815,356 A * 3/1989 Hupp ..... F41A 3/40 384/282
5,682,007 A * 10/1997 Dobbins ..... F41A 3/46 42/16
7,849,777 B1 * 12/2010 Zedrosser ..... F41A 3/72 89/1.4
2014/0311005 A1 * 10/2014 Tertin ..... F41A 3/20 42/16
2015/0316336 A1 * 11/2015 Lee ..... F41A 19/35 42/16
2016/0187082 A1 * 6/2016 Pizano ..... F41A 5/24 89/194
2019/0162493 A1 * 5/2019 Hopkins ..... F41A 3/42

* cited by examiner

FIREARM ACTION

CROSS-REFERENCE TO RELATED APPLICATION

This application claims the benefit of U.S. Provisional Patent Application No. 62/702,523 filed on Jul. 24, 2018, entitled "STRAIGHT PULL BOLT ACTION FIREARM WITH DUAL OPPOSED LOCKING LUGS," which is hereby incorporated by reference in its entirety for all that is taught and disclosed therein.

FIELD OF THE INVENTION

The present invention relates to firearms, and more particularly to a firearm action that includes a bolt that slides forward and backward without rotating to lock and unlock the bolt.

BACKGROUND OF THE INVENTION

The typical bolt action rifle uses a turn-bolt action design, which requires the user to make an upward turn movement of the bolt handle to unlock the bolt, followed by a rearward pull to eject the discharged case. The user then pushes the bolt handle forward to strip the next cartridge from the magazine and chamber the cartridge, and subsequently makes a downward turn movement of the bolt handle to lock the bolt to place the rifle in battery ready to be fired. The disadvantage of requiring rotations of the bolt handle is the rate of fire of the rifle is reduced compared to a straight-pull action. A straight-pull action cycles the bolt without rotating the bolt handle. The reduces the user's required bolt handle movements to just forward and backward, making operation of the rifle faster and easier compared to a turn-bolt action. Straight-pull actions have the additional advantage of not requiring bolt rotations than can exert undesirable torque on the rifle that might disturb the rifle's aim.

Therefore, a need exists for a new and improved firearm action that includes a bolt that slides forward and backward without rotating to lock and unlock the bolt. In this regard, the various embodiments of the present invention substantially fulfill at least some of these needs. In this respect, the firearm action according to the present invention substantially departs from the conventional concepts and designs of the prior art, and in doing so provides an apparatus primarily developed for the purpose of providing a firearm action that includes a bolt handle that slides forward and backward without rotating to lock and unlock the bolt.

SUMMARY OF THE INVENTION

The present invention provides an improved firearm action, and overcomes the above-mentioned disadvantages and drawbacks of the prior art. As such, the general purpose of the present invention, which will be described subsequently in greater detail, is to provide an improved firearm action that has all the advantages of the prior art mentioned above.

To attain this, the preferred embodiment of the present invention essentially comprises a receiver defining a bolt passage and having a latch engagement facility, a bolt assembly including a bolt body received in the passage and operable to reciprocate between a forward battery position and a rear open position, the bolt assembly including a bolt handle movable with respect to the body between a handle forward position and a handle rearward position, the bolt assembly including a bolt latch body having a latch element, the bolt latch body movable between a locked condition in which the latch element engages the latch engagement facility when the bolt assembly is in the forward position and the bolt handle is in the forward position to prevent reciprocation of the bolt, and an unlocked position in which the latch element is disengaged from the latch engagement facility to enable reciprocation of the bolt. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
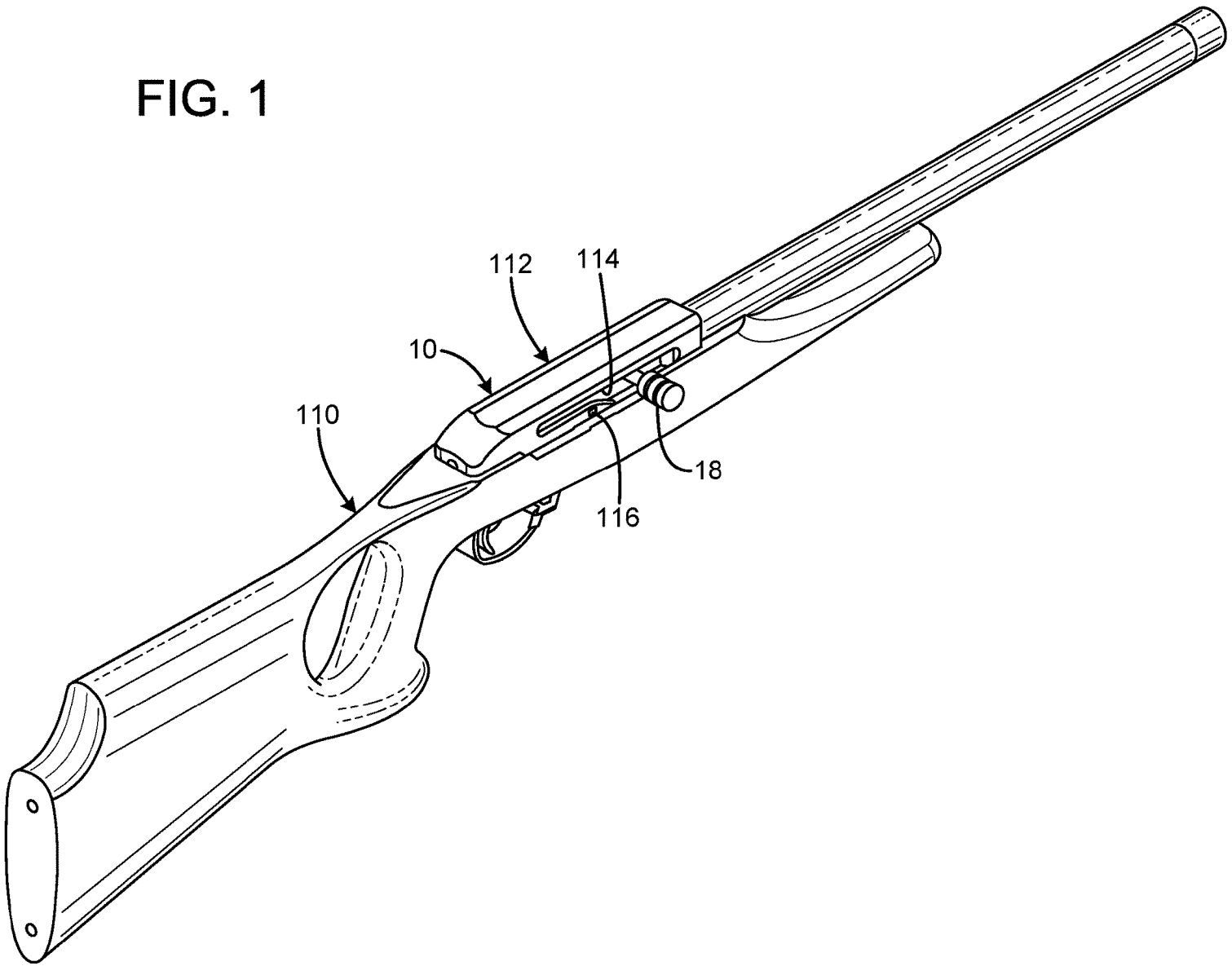
FIG. 1 is a top isometric view of a Magnum Research® MLR rifle with the current embodiment of the firearm action constructed in accordance with the principles of the present invention installed.

An embodiment of the firearm action of the present invention is shown and generally designated by the reference numeral 10.

Figure 2:
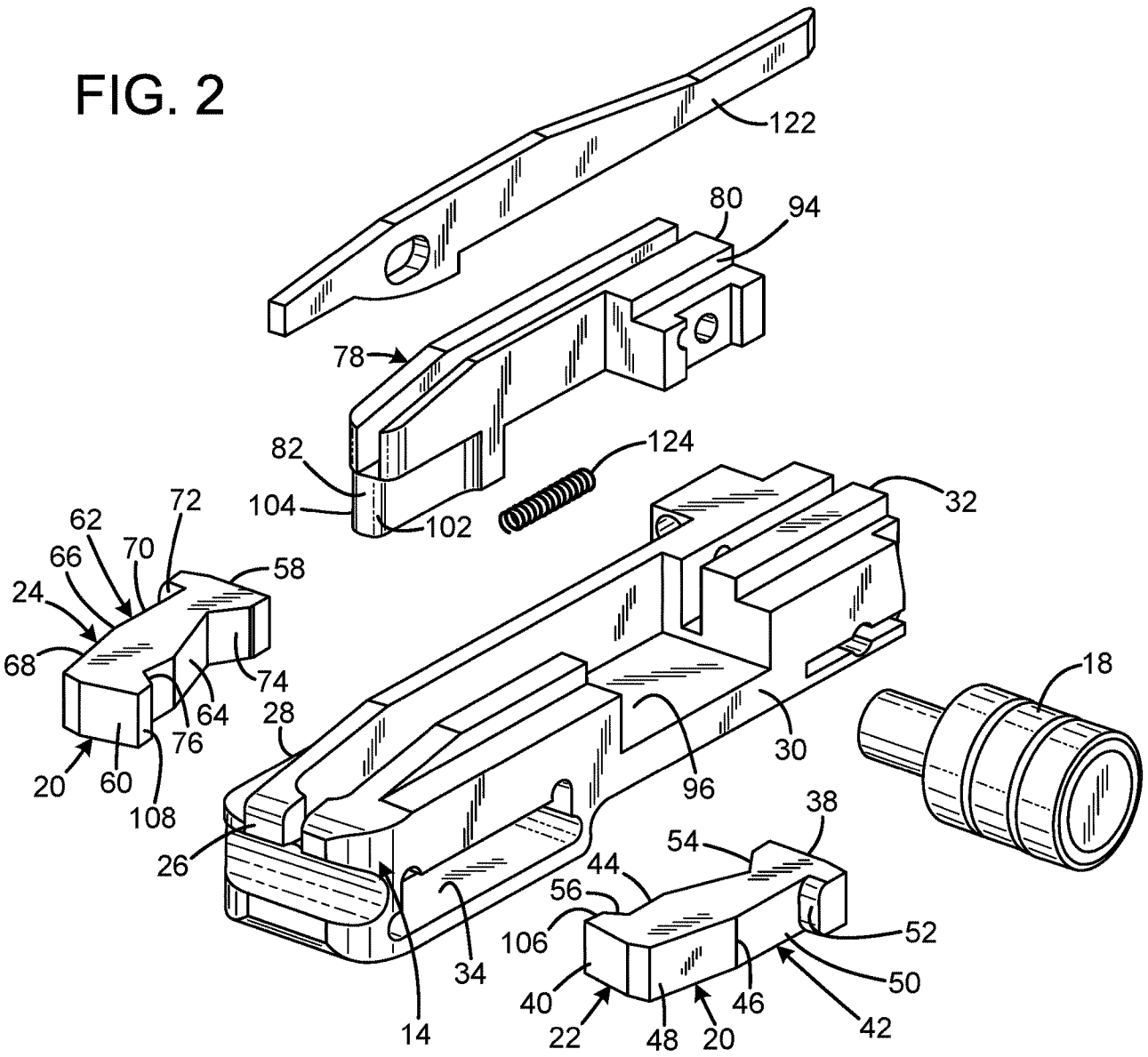
FIG. 2 is a top isometric exploded view of the firearm action of FIG. 1.
Figure 3:
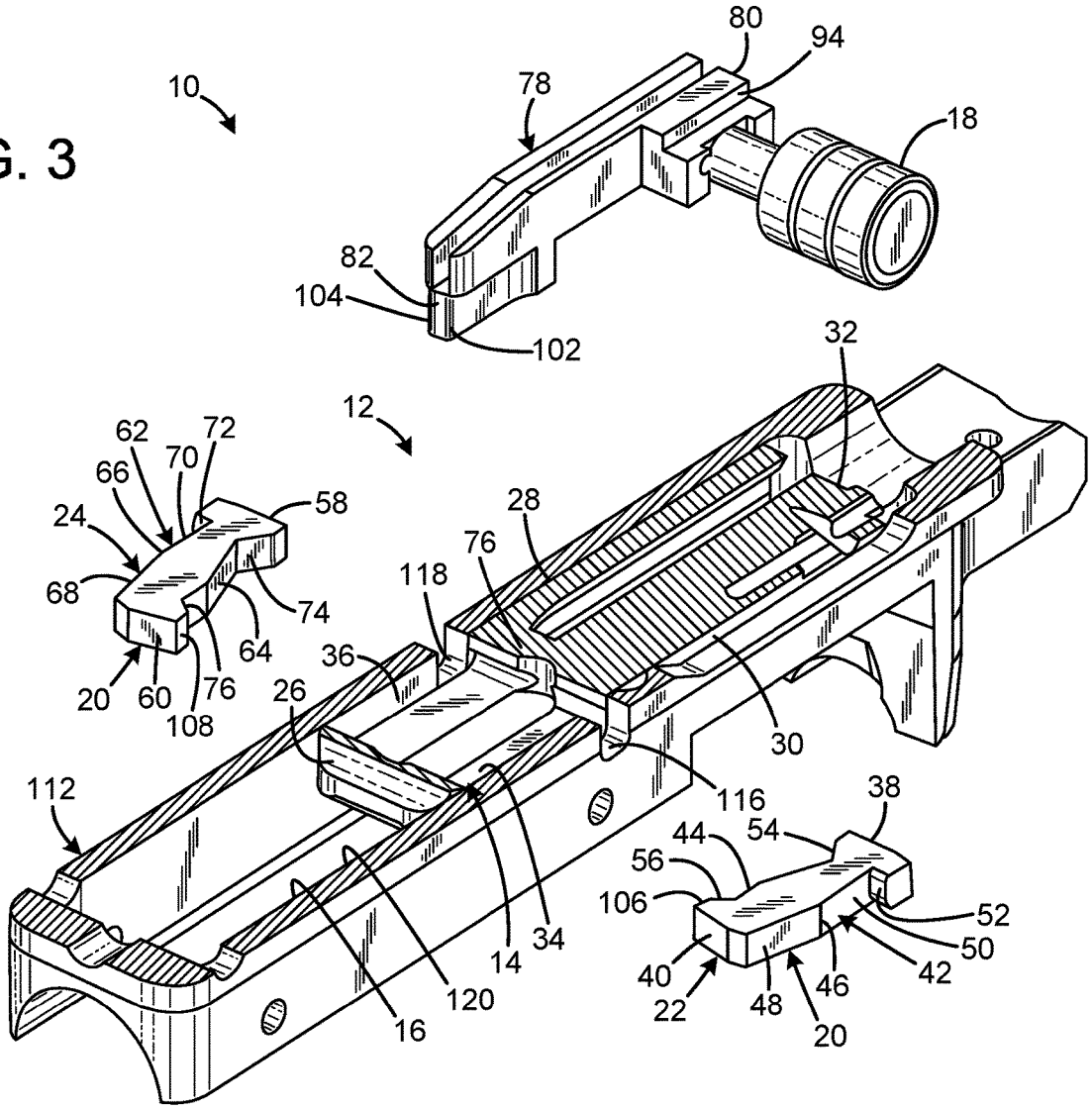
FIG. 3 is a top isometric exploded view of the firearm action of FIG. 1 with the receiver and bolt body shown in partial section.
Figure 4:
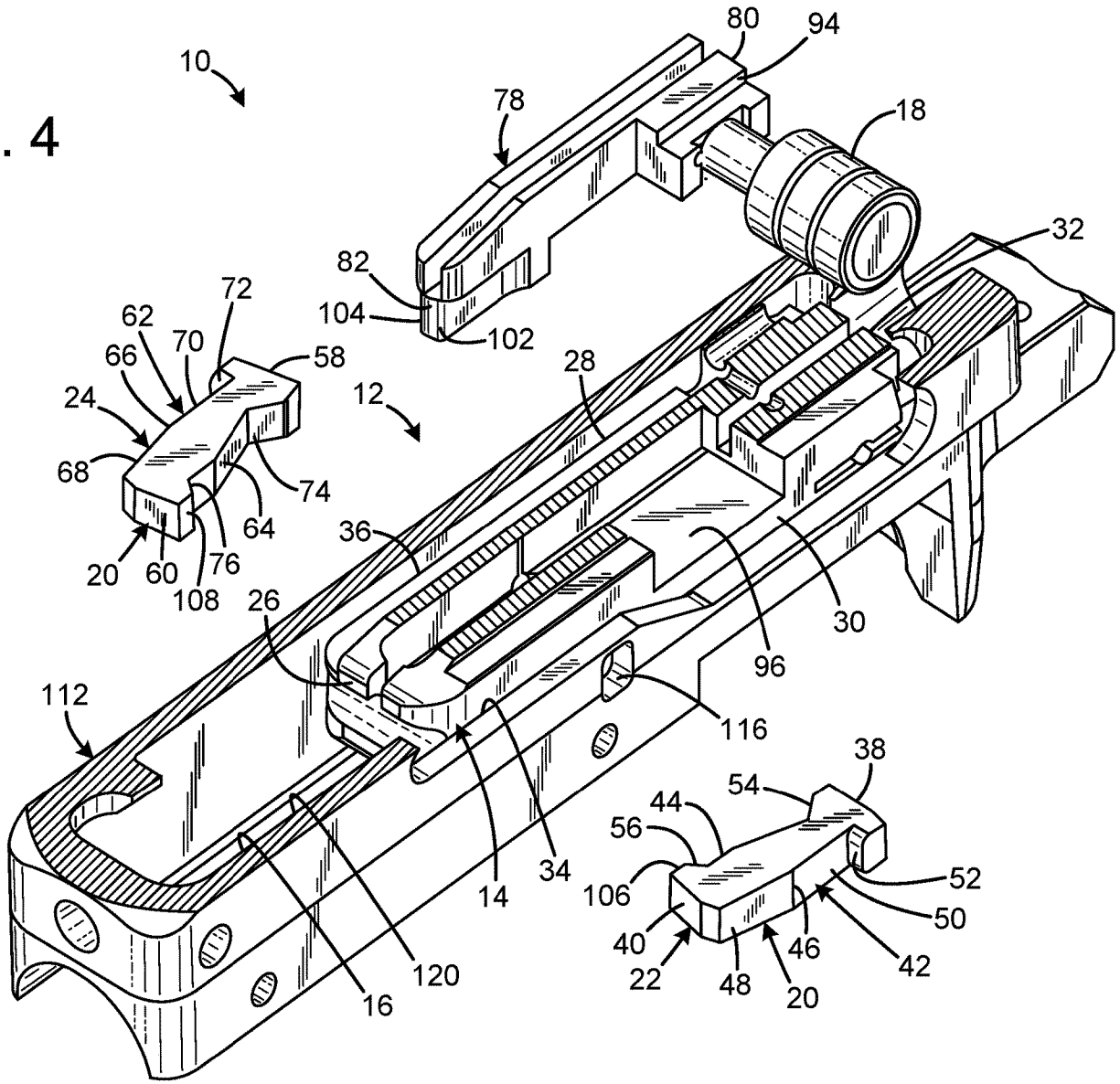
FIG. 4 is a top isometric exploded view of the firearm action of FIG. 1 with the receiver, bolt body, and bolt latch body shown in partial section.

FIGS. 1-4 illustrate the improved firearm action 10 of the present invention. More particularly, the firearm action is shown installed in a Magnum Research® MLR rifle 110 in FIG. 1 manufactured by Magnum Research, Inc. of Pillager, Minn. The Magnum Research® MLR rifle has a receiver 112 that includes right and left latch engagement facilities 116, 118, which are recesses on an interior portion 120 of the receiver. The firearm action includes a bolt assembly 12 including a bolt body 14 that reciprocates within the receiver within a bolt passage 16 defined by the receiver. FIG. 2 depicts an exploded view of the bolt assembly. FIGS. 3 & 4 show different partial sectional views of the receiver and bolt assembly. The bolt body is received within bolt passage and is operable to reciprocate between a forward battery position and a rear open position. The bolt assembly includes a bolt handle 18 that is movable with respect to the bolt body between a handle forward position and a handle rearward position. The bolt assembly includes a bolt latch body 20 having right and left latch elements 22, 24. The bolt latch body is movable between a locked condition in which the latch element engages the latch engagement facility when the bolt assembly is in the forward position and the bolt handle is in the forward position to prevent reciprocation of the bolt body, and an unlocked position in which the bolt latch element is disengaged from the latch engagement facility to enable reciprocation of the bolt body. The bolt assembly also includes a firing pin 122.

The bolt body 14 has a rear 26, left side 28, right side 30, and a front 32. The bolt body has horizontal precise slots 34, 36 cut on either side that hold the right and left latch elements 22, 24 in position. The right and left latch elements are free floating. The right latch element has a front 38, rear 40, outer surface 42, and inner surface 44. The right latch element is a planar body oriented in a horizontal plane. The outer surface is configured to contact the receiver and includes a pivot point 46, a rear surface portion 48 aft of the pivot point, and a forward surface portion 50 forward of the pivot point. The rear and forward surface portions are linear surfaces angularly offset from each other. However, it should be appreciated that the rear and forward surface portions do not have to be planar surfaces. Instead, the rear and forward surface portions could be defined by a pivot point and remote point, such as a broad T shape with a short vertical as opposed to the broad and short V shape illustrated. The right latch element also includes a rear facing latch surface 52. The inner surface includes a forward key engagement cam surface 54 facing rearward and inward and a rear key engagement cam surface 56 facing forward and inward.

The left latch element 24 has a front 58, rear 60, outer surface 62, and inner surface 64. The left latch element is a planar body oriented in a horizontal plane. The outer surface is configured to contact the receiver and includes a pivot point 66, a rear surface portion 68 aft of the pivot point, and a forward surface portion 70 forward of the pivot point. The rear and forward surface portions are linear surfaces angularly offset from each other. However, it should be appreciated that the rear and forward surface portions do not have to be planar surfaces. Instead, the rear and forward surface portions could be defined by a pivot point and remote point, such as a broad T shape with a short vertical as opposed to the broad and short V shape illustrated. The right latch element also includes a rear facing latch surface 72. The inner surface includes a forward key engagement cam surface 74 facing rearward and inward and a rear key engagement cam surface 76 facing forward and inward.

The bolt handle 18 includes a key element 78 configured to contact the bolt latch body 20 consisting of right and left latch elements 22, 24 and to restrain the bolt latch body in the locked condition when the bolt handle is in the forward position and to restrain the bolt latch body in the unlocked condition when the bolt handle is in the rear position. The key element has a front 80 and a rear 82. The rear of the bolt handle is precisely machined to operate the right and left latch elements by interacting with their forward key engagement cam surfaces 54, 74 and their rear key engagement cam surfaces 56, 76. Specifically, the rear of the key element of the bolt handle mechanically cams the two dual and opposed right and left latch elements of the bolt latch body outward to the locked position to restrain the bolt body 14 when the key element is in the forward position, and cams the right and left latch elements inward to the unlocked position to permit reciprocation of the bolt body when the bolt handle is in the rearward position.

Figure 5:
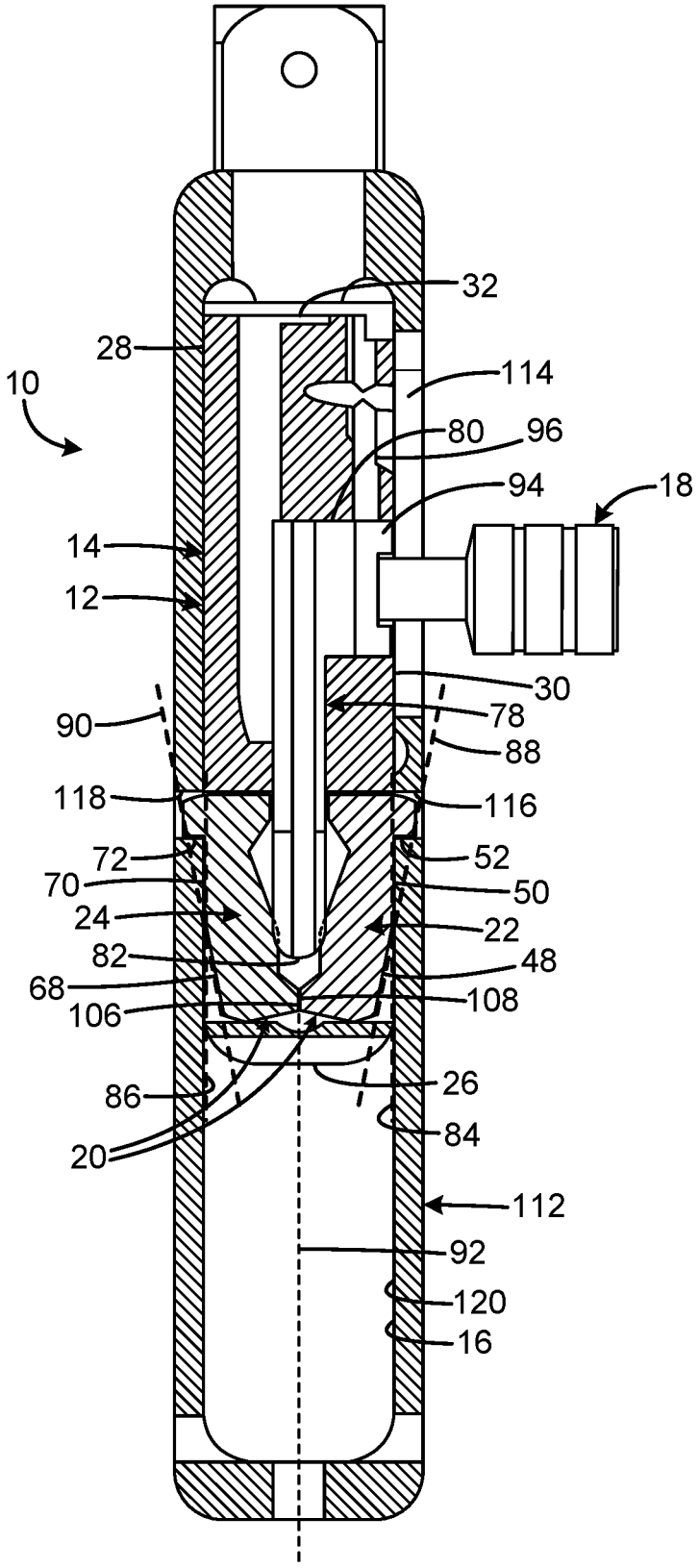
FIG. 5 is a top section view of the firearm action of FIG. 1 with the bolt latch body shown in the locked condition and the bolt body shown in full battery.

FIG. 5 illustrates the improved firearm action 10 of the present invention. More particularly, the firearm action is shown with the bolt latch body 20 in the locked condition and the bolt body 14 in full battery with the loaded cartridge (not shown) ready to be discharged. The rear facing latch surfaces 52, 72 on the right and left latch elements 22, 24 are received by the left and right latch engagement facilities 116, 118 of the receiver 112 to lock the bolt body in place. The rears 40, 60 of the right and left latch elements also contact one another at surfaces 106, 108 for a solid, very strong lock up. The contact at surfaces 106,108 also provides the benefits of maintaining a solid, dependable headspace dimension and reducing wear and strain on the entire locking system. The forward surface portions 50, 70 each define a forward plane 84, 86, and the rear surface portions 48, 68 each define a rear plane 88, 90. In the current embodiment, the right and left latch elements are laterally inward of their rear planes and protrude laterally outward from their forward planes. The rear facing latch surfaces 52, 72 are perpendicular to their forward planes. The bolt passage 16 defines a major axis 92, and none of the bolt body, bolt handle 18, and bolt latch body 20 rotate on the major axis. Furthermore, the bolt body, bolt handle, and bolt latch body are restrained against rotation on the major axis. The bolt body is rotationally engaged to the receiver to remain in a consistent orientation throughout reciprocation. A block portion 94 at the front 80 of the bolt handle is captured within a slot 96 in the bolt body that limits movement of the bolt handle to reciprocation.

Figure 6:
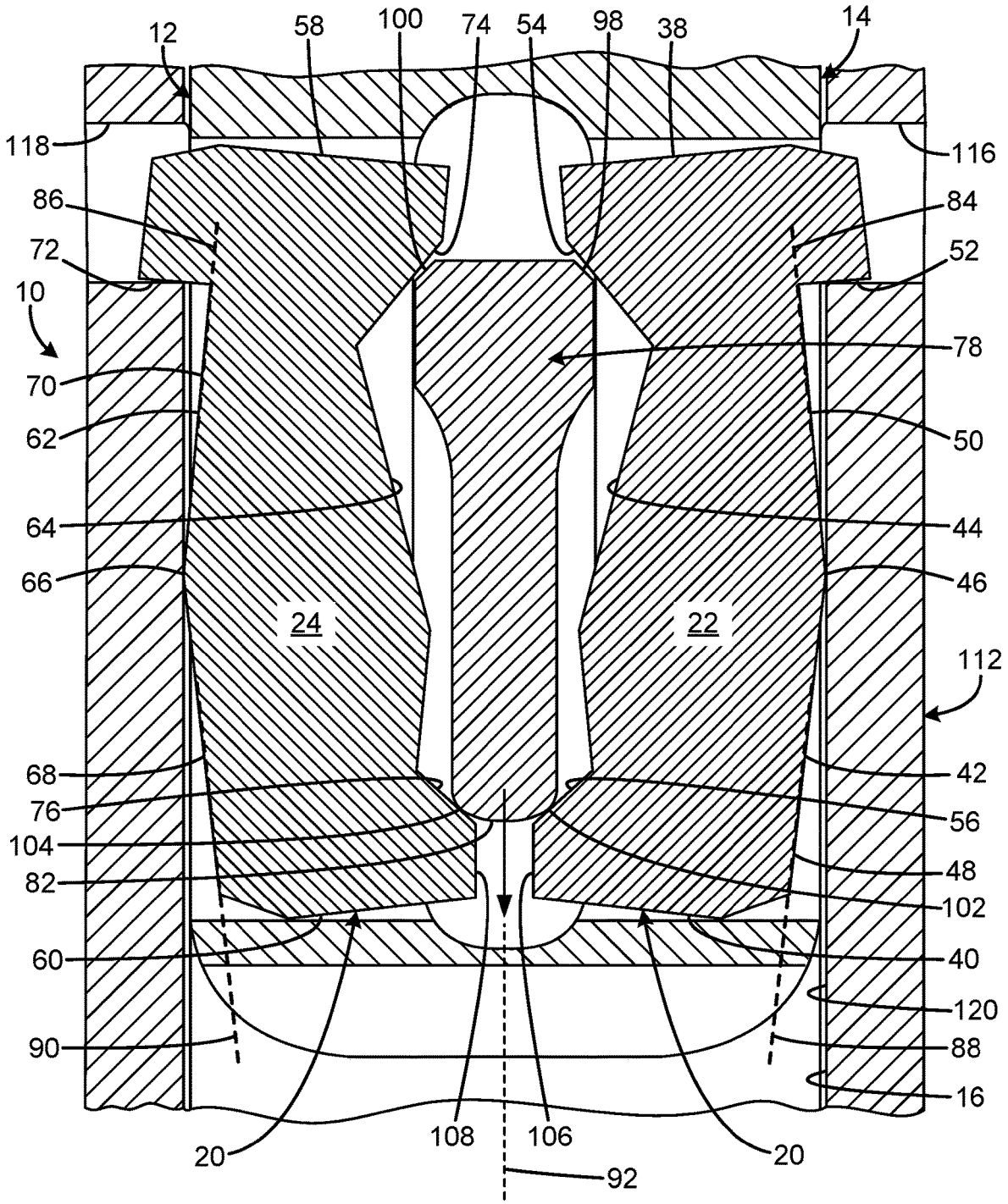
FIG. 6 is a top section view of the firearm action of FIG. 1 with the bolt latch body shown transitioning from the locked condition to the unlocked condition and the bolt body shown in the same position as FIG. 4.

FIG. 6 illustrates the improved firearm action 10 of the present invention. More particularly, the firearm action is shown with the bolt latch body 20 transitioning from the locked condition to the unlocked condition, which occurs after the user discharges the loaded cartridge. The user has pulled the bolt handle 18 partially rearward within slot 96, which causes forward cam surfaces 98, 100 on the rear 82 of the key element 78 to stop applying outward pressure to the forward key engagement cam surfaces 54, 74 on the right and left latch elements 22, 24. Simultaneously, contact between the rear cam surfaces 102, 104 on the rear of the key element and the rear key engagement cam surfaces 56, 76 on the right and left latch elements causes the rears 40, 60 of the right and left latch elements to pivot about pivot points 46, 66 and begin withdrawing the rear facing latch surfaces 52, 72 from the right and left latch engagement facilities 116, 118. The bolt body 14 continues to be restrained in the same position shown in FIG. 5.

Figure 7:
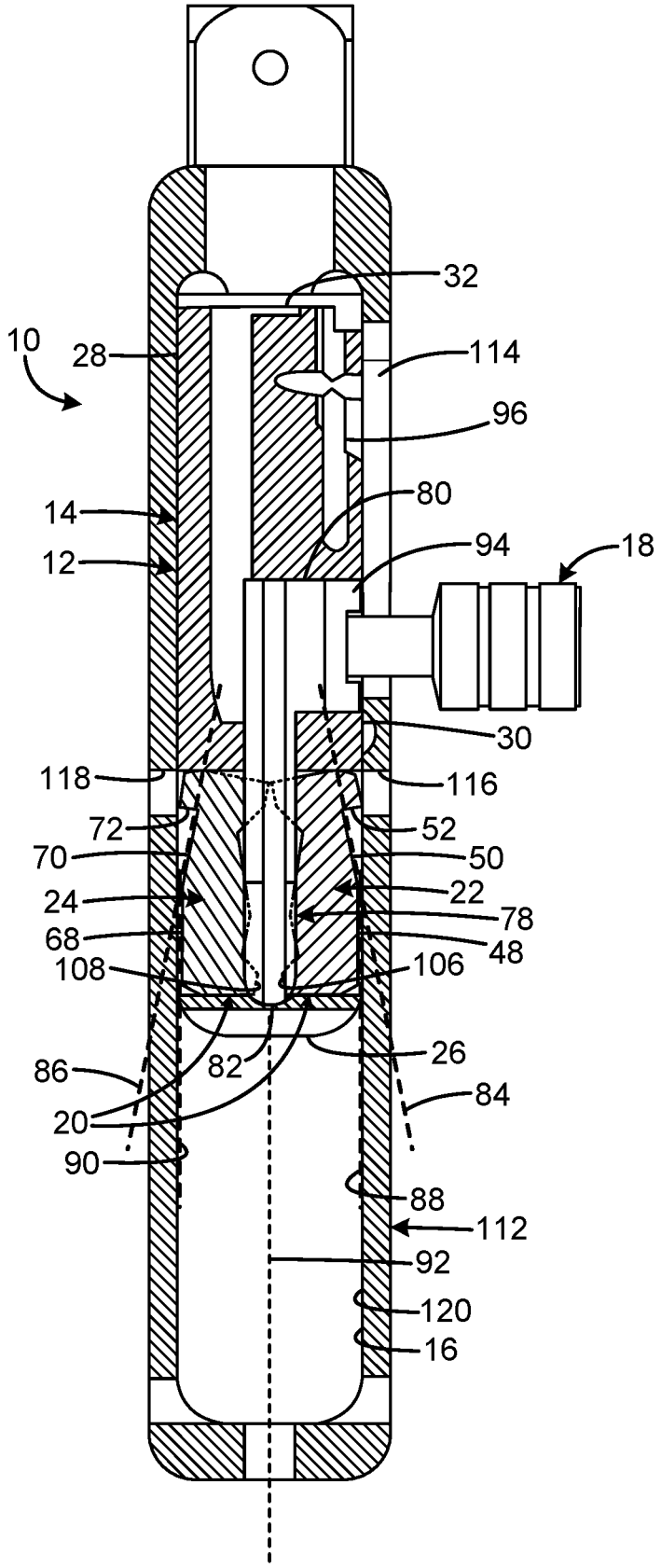
FIG. 7 is a top section view of the firearm action of FIG. 1 with the bolt latch body shown in the unlocked position and the bolt body shown in same position as FIG. 4.

FIG. 7 illustrates the improved firearm action 10 of the present invention. More particularly, the firearm action is shown with the bolt latch body 20 having completed the transition from the locked condition to the unlocked condition. The bolt body 14 remains in the same position as FIG. 5. The user has pulled the bolt handle 18 fully rearward within slot 96, which has caused the rears 40, 60 of the right and left latch elements to pivot about pivot points 46, 76 until their rear surface portions 48, 68 abut the exterior surfaces of the bolt body without protruding. In this position, the rear facing latch surfaces 52, 72 are fully withdrawn from the right and left latch engagement facilities 116,118, thereby enabling reciprocation of the bolt body 14 within the bolt passage 16. In this position, the right and left latch elements 22, 24 are withdrawn completely into the cuts 34, 36 in the bolt body so the right and left latch elements do not protrude beyond the bolt body's exterior surfaces to avoid contacting the interior portion of the receiver when the bolt body reciprocates within the bolt passage. Subsequently, the user continues to pull the bolt handle rearward to slide the bolt body rearward within the bolt passage 16. The bolt body extracts the fired case from the chamber and ejects the fired case through the ejection port 114 when the bolt body reaches the rearwardmost position.

Figure 8:
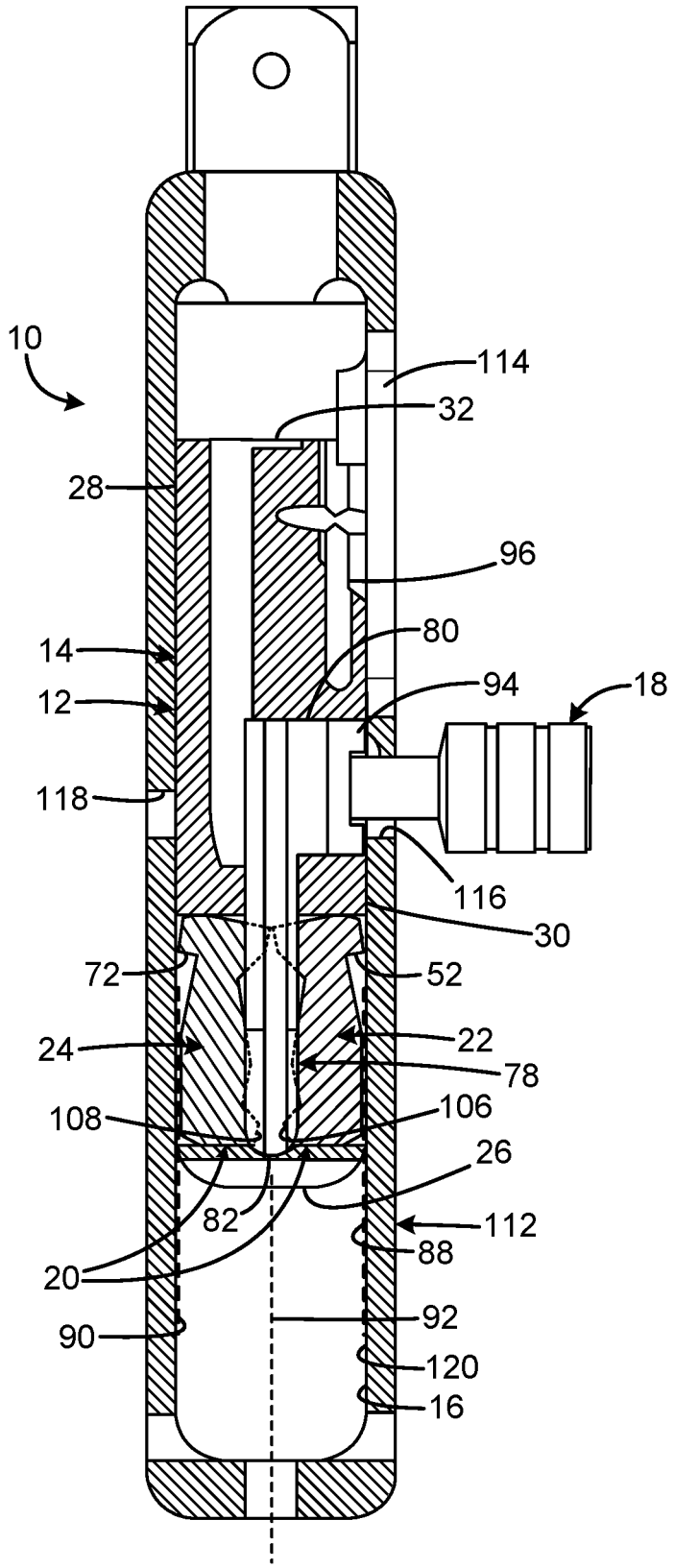
FIG. 8 is a top section view of the firearm action of FIG. 1 with the bolt latch body shown in the unlocked position and the bolt body shown in the process of cycling rearward.

FIG. 8 illustrates the improved firearm action 10 of the present invention. More particularly, the firearm action is shown with the bolt body 14 in the process of cycling rearward within the bolt passage 16 while the user continues to hold the bolt handle 18 fully rearward to keep the bolt latch body 20 in the unlocked condition.

Figure 9:
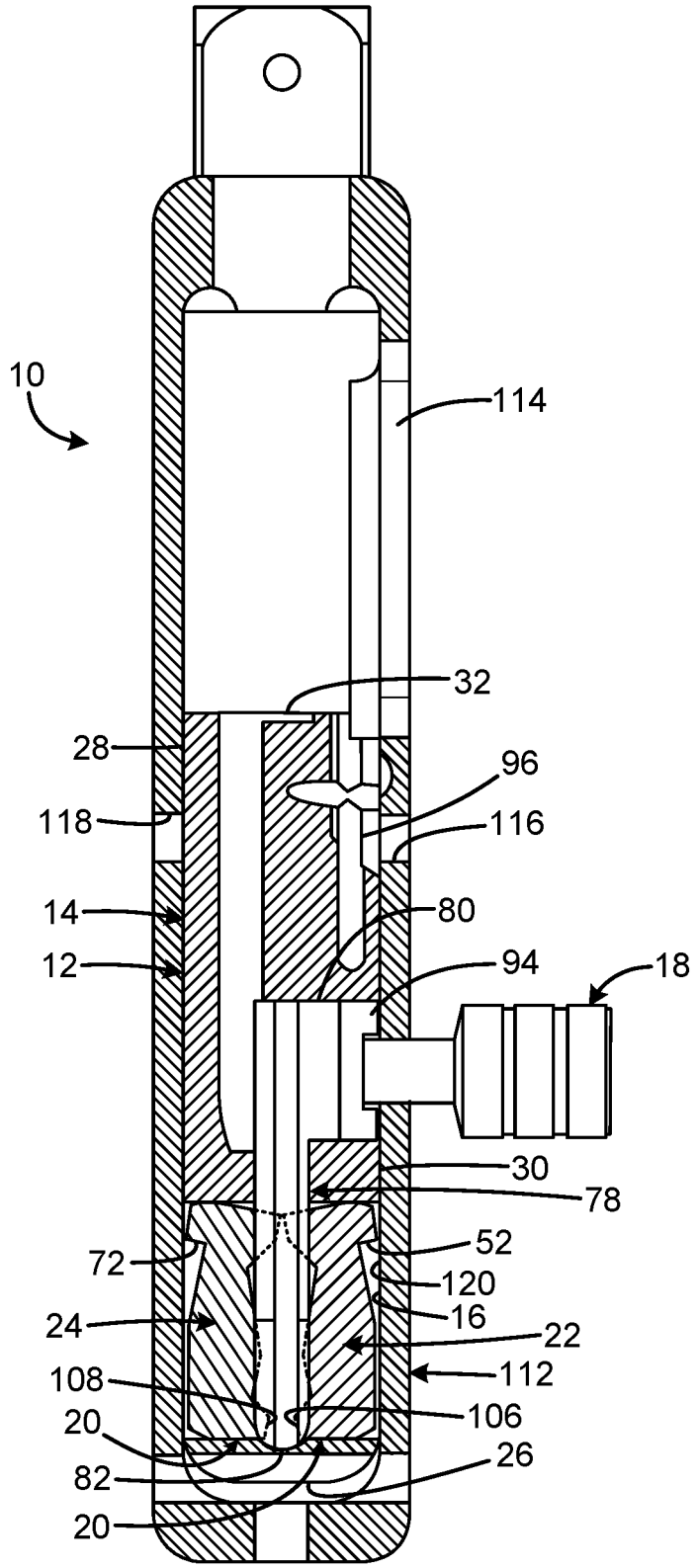
FIG. 9 is a top section view of the firearm action of FIG. 1 with the bolt latch body shown in the unlocked position and the bolt body shown fully rearward.

FIG. 9 illustrates the improved firearm action 10 of the present invention. More particularly, the firearm action is shown with the bolt body 14 fully rearward within the bolt passage 16 while the user continues to hold the bolt handle 18 fully rearward to keep the bolt latch body 20 in the unlocked condition.

Figure 10:
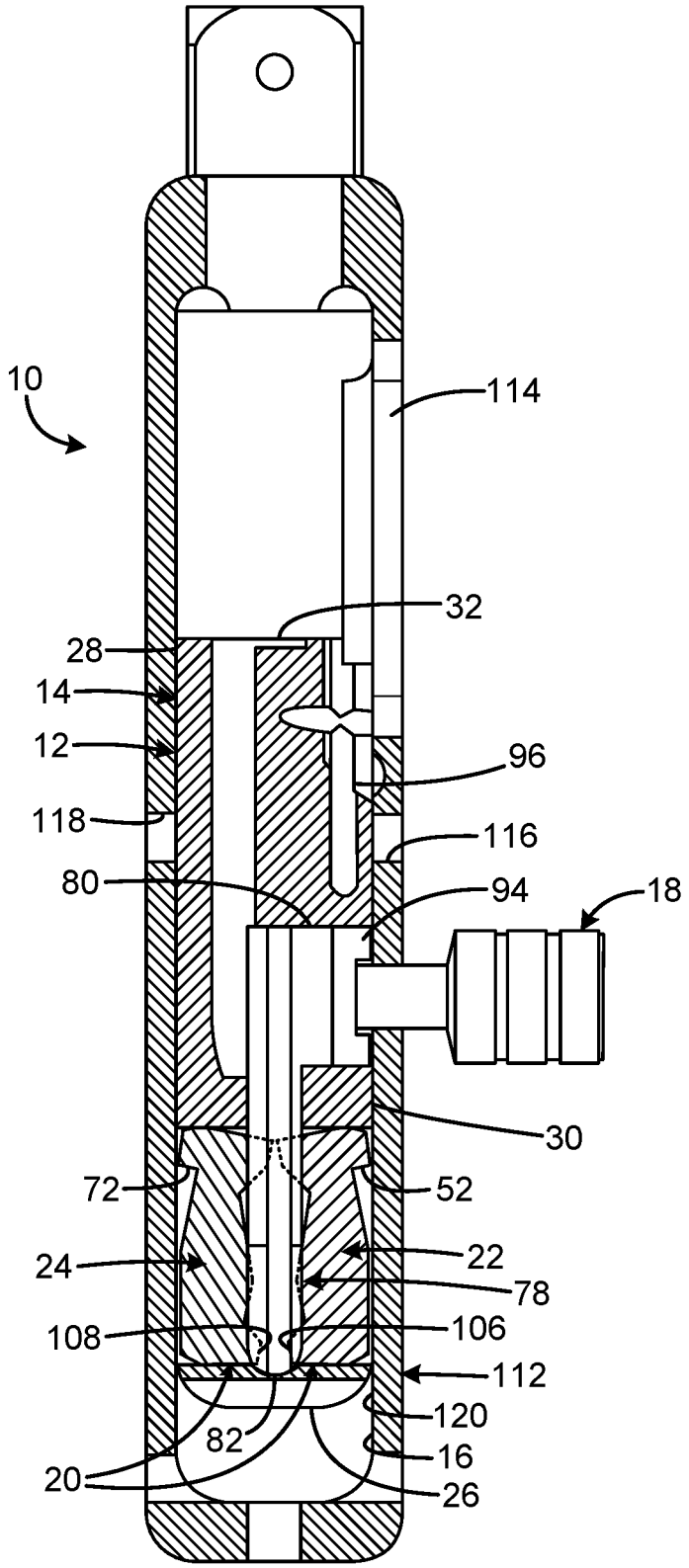
FIG. 10 is a top section view of the firearm action of FIG. 1 with the bolt latch body shown in the unlocked position and the bolt body shown in the process of cycling forward.

FIG. 10 illustrates the improved firearm action 10 of the present invention. More particularly, the firearm action is shown with the bolt body 14 in the process of cycling forward within the bolt passage 16 as the user pushes the bolt handle 18 forward to push the bolt body back into battery. As the bolt handle is pushed forward, the bolt body picks up and feeds a cartridge out of the magazine and inserts it into the chamber.

Figure 11:
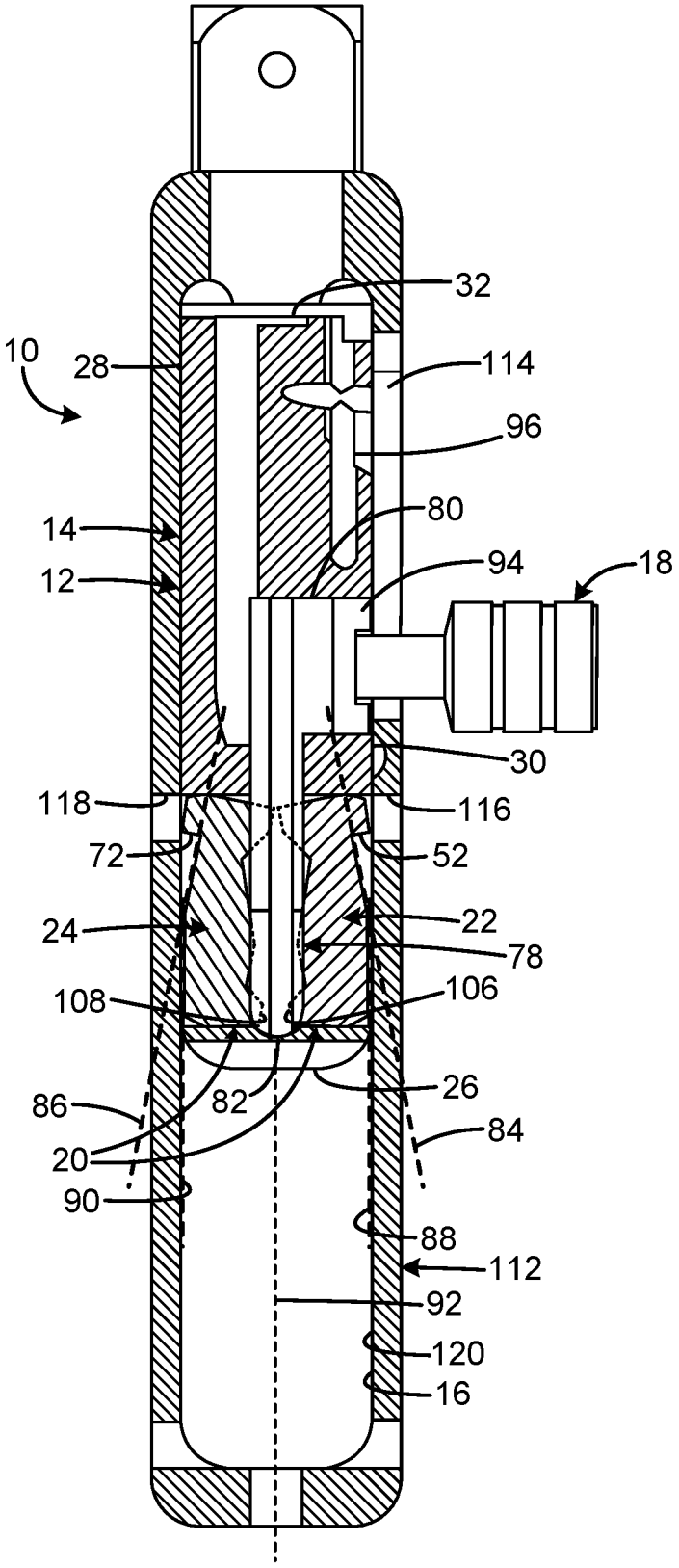
FIG. 11 is a top section view of the firearm action of FIG. 1 with the bolt latch body shown at the moment of beginning the transition from the unlocked position to the locked position and the bolt body shown fully forward.

FIG. 11 illustrates the improved firearm action 10 of the present invention. More particularly, the firearm action is shown at the instant right before the user pushes the bolt handle 18 fully forward to insert the rear facing latch surfaces 52, 72 into the right and left latch engagement facilities 116, 118 to return the bolt latch body 20 to the locked condition with the bolt body 14 in full battery shown in FIG. 5. When the cartridge is fully inserted into the chamber by the bolt body 14, and the bolt body is obstructed from further forward movement, the user continues to push the bolt handle 18 fully forward within slot 96. As the bolt handle moves fully forward within slot 96, forward cam surfaces 98, 100 on the rear 82 of the key element 78 apply outward pressure to the forward key engagement cam surfaces 54, 74 on the right and left latch elements 22, 24. This pressure causes the forward surface portions 50, 70 of the right and left latch elements 22, 24 to pivot outward about pivot points 46, 66 until the forward surfaces portions 50, 70 abut the exterior surfaces of the bolt body without protruding. Simultaneously, pressure is no longer applied between the rear cam surfaces 102, 104 on the rear of the key element and the rear key engagement cam surfaces 56, 76 on the right and left latch elements.

While a current embodiment of the firearm action has been described in detail, it should be apparent that modifications and variations thereto are possible, all of which fall within the true spirit and scope of the invention. For example, a coil spring (element 124 in FIG. 1) and a guide rod (not shown) may be located on the side of the bolt body and butt up against the rear of the receiver. This spring pushes the bolt body and acts as a "forward assist" when operating the firearm action of the current invention. The spring is easily overcome when operating the firearm action by pulling the bolt handle in a rearward manner, but assists in closing the bolt body when the bolt handle is moved forward to lock the firearm action. It should be appreciated that the spring and guide rod do not close the bolt body; the spring simply assists with the manual operation of the firearm action. Furthermore, the firearm action of the current invention can be used with a handgun as well as the rifle disclosed. The firearm action of the current invention can be used with both rimfire and center fire cartridges. Finally, the bolt handle and key element can be made ambidextrous so the bolt handle can be switched to the other side of the key element for both right and left-handed use in the field. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm action comprising:

a receiver defining a bolt passage and having a latch engagement facility;

a bolt assembly including a bolt body received in the bolt passage and operable to reciprocate between a forward battery position and a rear open position;

the bolt assembly including a bolt handle movable with respect to the body between a handle forward position and a handle rearward position;

the bolt assembly including a bolt latch body having a latch element;

the bolt handle being movable with respect to the bolt latch body;

the bolt latch body movable between a locked condition in which the latch element engages the latch engagement facility when the bolt assembly is in the forward position and the bolt handle is in the forward position to prevent reciprocation of the bolt body, and an unlocked position in which the bolt latch element is disengaged from the latch engagement facility to enable reciprocation of the bolt body; and wherein the bolt handle includes a key element configured to contact the bolt latch body and to restrain the bolt latch body in the unlocked condition when the bolt handle is in the rear position.

2. The firearm action of claim 1 wherein the latch engagement facility is a recess on an interior portion of the receiver.

3. The firearm action of claim 1 wherein the bolt body is rotationally engaged to the receiver to remain in a consistent orientation throughout reciprocation.

4. The firearm action of claim 1 wherein the latch element is a planar body oriented in a horizontal plane.

5. The firearm action of claim 1 including a pair of opposed latches, including the bolt latch body and a second bolt latch body, each operable to engage an opposed portion of the receiver.

6. The firearm action of claim 5 wherein the bolt handle includes a key element intervening between the bolt latch bodies and operably connected thereto.

7. The firearm action of claim 1 wherein the key element is configured to contact the bolt latch body and to restrain the bolt latch body in the locked condition when the bolt handle is in the forward position.

8. The firearm action of claim 1 wherein the latch element has an outer surface configured to contact the receiver, the outer surface including a pivot point, a rear surface portion aft of the pivot point and defining a rear plane, and a forward surface portion forward of the pivot point and defining a forward plane.

9. The firearm action of claim 8 wherein the latch element is laterally inward of the rear plane and protrudes laterally outward from the forward plane.

10. The firearm action of claim 8 wherein the latch element includes a rear facing latch surface perpendicular to the forward plane.

11. The firearm action of claim 8 wherein the latch element includes a forward key engagement cam surface facing rearward and inward.

12. The firearm action of claim 8 wherein the latch element includes a rear key engagement cam surface facing forward and inward.

13. The firearm action of claim 8 wherein the latch element rear surface portion and forward surface portion are linear surfaces angularly offset from each other.

14. The firearm action of claim 1 wherein the bolt passage defines a major axis and none of the bolt body, bolt handle, and bolt latch body rotate on the major axis.

15. The firearm action of claim 1 wherein the bolt passage defines a major axis and the bolt body, bolt handle, and bolt latch body are restrained against rotation on the major axis.

16. The firearm action of claim 1 wherein the bolt handle includes a key element configured to contact the bolt latch body and to restrain the bolt latch body in the locked condition when the bolt handle is in the forward position.

17. A firearm action comprising:

a receiver defining a bolt passage and having a latch engagement facility;

a bolt assembly including a bolt body received in the bolt passage and operable to reciprocate between a forward battery position and a rear open position;

the bolt assembly including a bolt handle movable with respect to the body between a handle forward position and a handle rearward position;

the bolt assembly including a bolt latch body having a latch element;

the bolt handle being movable with respect to the bolt latch body;

the bolt latch body movable between a locked condition in which the latch element engages the latch engagement facility when the bolt assembly is in the forward position and the bolt handle is in the forward position to prevent reciprocation of the bolt body, and an unlocked position in which the bolt latch element is disengaged from the latch engagement facility to enable reciprocation of the bolt body;

including a pair of opposed latches, including the bolt latch body and a second bolt latch body, each operable to engage an opposed portion of the receiver;

wherein the bolt handle includes a key element intervening between the bolt latch bodies and operably connected thereto; and wherein the key element is configured to contact the bolt latch bodies and to restrain the bolt latch bodies in the locked condition when the bolt handle is in the forward position and to restrain the bolt latch bodies in the unlocked condition when the bolt handle is in the rear position.

18. A firearm action comprising:

a receiver defining a bolt passage and having a latch engagement facility;

a bolt assembly including a bolt body received in the bolt passage and operable to reciprocate between a forward battery position and a rear open position;

the bolt assembly including a bolt handle movable with respect to the body between a handle forward position and a handle rearward position;

the bolt assembly including a bolt latch body having a latch element;

the bolt handle being movable with respect to the bolt latch body;

the bolt latch body movable between a locked condition in which the latch element engages the latch engagement facility when the bolt assembly is in the forward position and the bolt handle is in the forward position to prevent reciprocation of the bolt body, and an unlocked position in which the bolt latch element is disengaged from the latch engagement facility to enable reciprocation of the bolt body;

wherein the latch element has an outer surface configured to contact the receiver, the outer surface including a pivot point, a rear surface portion aft of the pivot point and defining a rear plane, and a forward surface portion forward of the pivot point and defining a forward plane; and wherein the latch element is laterally inward of the rear plane and protrudes laterally outward from the forward plane.

19. The firearm action of claim 18 wherein the latch element includes a rear facing latch surface perpendicular to the forward plane.

20. The firearm action of claim 18 wherein the latch element includes a forward key engagement cam surface facing rearward and inward.

21. The firearm action of claim 18 wherein the latch element includes a rear key engagement cam surface facing forward and inward.

22. The firearm action of claim 18 wherein the latch element rear surface portion and forward surface portion are linear surfaces angularly offset from each other.

* * * * *